United States Patent [19]

Setterberg

[11] Patent Number: 4,636,086

[45] Date of Patent: Jan. 13, 1987

[54] VIBRATOR EQUIPPED WITH FASTENING DEVICE

[76] Inventor: Lars I. Setterberg, Mjölnartorpsvägen 11, S-182 63 Djursholm, Sweden

[21] Appl. No.: 701,173

[22] Filed: Feb. 13, 1985

[30] Foreign Application Priority Data

Feb. 15, 1984 [SE] Sweden ..... 8400815

[51] Int. Cl.[4] ..... B01F 11/00

[52] U.S. Cl. ..... 366/114; 366/128

[58] Field of Search ..... 366/108, 110, 111, 112, 366/114, 116, 117, 118, 285, 286, 127, 128

[56] References Cited

U.S. PATENT DOCUMENTS

| | | | |
|---|---|---|---|
| 720,053 | 2/1903 | McKibben . | |
| 1,485,205 | 2/1924 | Sturtevant | 366/286 |
| 1,751,087 | 3/1930 | Jackson . | |
| 3,106,652 | 10/1963 | Burt | 366/114 |
| 3,301,535 | 1/1967 | Brown | 366/127 |
| 3,528,144 | 9/1970 | Haponski . | |
| 3,567,186 | 3/1971 | Niepelt | 366/114 |
| 3,633,878 | 1/1972 | Mendlus . | |
| 3,724,819 | 4/1973 | Varnum . | |
| 3,839,918 | 10/1974 | Fischer | 366/108 |
| 4,353,261 | 10/1982 | Salani . | |

*Primary Examiner*—Robert W. Jenkins

*Attorney, Agent, or Firm*—Young & Thompson

[57] ABSTRACT

A vibrator with vibratory action for the vibration of objects is described, where the vibrator is provided with an attachment device for attaching to the object which is to be vibrated, and is distinguished in that the attachment device constitutes a magnet, preferably an electromagnet.

2 Claims, 3 Drawing Figures

VIBRATOR EQUIPPED WITH FASTENING DEVICE

Apart from conveying bulk goods by vibration, vibrators are also used for compacting material masses, e.g. in road-making, concrete casting in forms or moulds, and they can also be used for increasing the density of material masses of different kinds in different kinds in different moulds or forms.

In concrete casting there are used tubular vibrators which are pushed down into the concrete poured into the form, or vibrators which are rigidly mounted on the outside of the form, these vibrators usually being bolted onto steel beams fixed to the form.

For increasing the density of different kinds of material masses in moulds, there are used templates which are removable after the density-increasing operation, e.g. in lining metallurgical vessels. One or more vibrators are attached to the template, usually by welding or by bolting to reinforcements on it.

It is thus usual to fasten a vibrator as rigidly as possible to that which is to be vibrated, whether it is a vibrating conveyor or a mould. The idea behind this is that the movements of the vibrator will be transferred as intimately as possible, with a little a loss as possible to that which is to be vibrated.

When concrete or a material mass in a mould or form is to be vibrated with the aid of a vibrator or vibrators mounted on the exterior of the form, these should be mounted at several levels to cover the entire depth of the form as well as its length. In such cases the vibrators at different levels are often laterally displaced in relation to each other.

In the known embodiments the vibrators are rigidly mounted, and if they are to be moved, the vibration must be interrupted, the vibrators removed and subsequently fastened again at a new place. This is extremely timeconsuming.

The present invention relates to a vibrator with a vibratory action for vibrating objects, which is provided with an attachment device for attaching it to the object which is to be vibrated, and is distinguished in that the device comprises a magnet, preferably an electromagnet.

The magnetic field of the electromagnet is controllable in relation to the vibratory force of the vibrator, or in relation to its amplitude or frequency.

The attachment plate of the electromagnetic attachment device can be flat or curved.

With its attachment device in accordance with the invention the vibrator is distinguished in that the vibrator unit is movable on the vibrated object while vibration is in progress.

Figure 1:
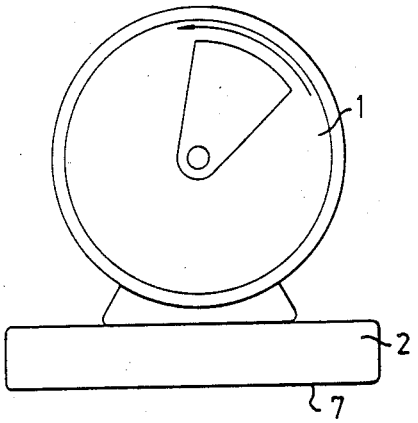
Figure 2:
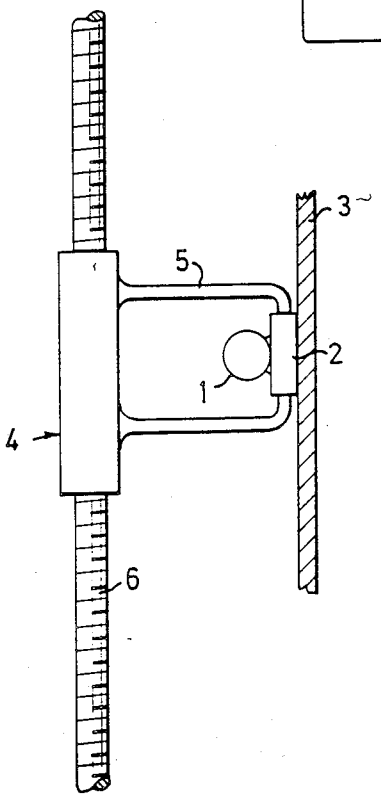
Figure 3:
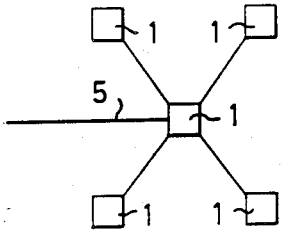

The invention will now be described in detail in connection with the accompanying schematic drawing, where FIG. 1 illustrates a vibrator fastened to an attachment plate, FIG. 2 illustrates means for moving the vibrator on a mould wall, and FIG. 3 finally illustrates a vibrator unit, or pack, seen from above, from one side or from below.

The vibrator 1, illustrated in FIG. 1 as a mechanical vibrator with an eccentric weight, is fastened to an attachment plate containing a magnet, preferably an electromagnet (not shown).

Via the attachment plate 2 the vibrator 1 can be attached to a mould wall 3 of magnetic material with the aid of the magnet. If the walls of the mould are not made from magnetic material, steel band or steel plates can be mounted on the mould walls.

The vibrator unit 1,2, or a vibrator pack (FIG. 3) is movable on the mould wall 3 during vibration, so that no part of the mould content will be insufficiently vibrated. It will be understood that the vibrators can be attached on either side of a mould or only on one side, all according to suitability.

In one embodiment, the field strength of the magnet in the attachment plate 2 is controllable in relation to the amplitude, vibratory force or frequency of the vibrator 1. Vibration can thus be controlled within wide ranges and also movement during vibration of the vibrator or vibrator unit.

The bottom face 7 of the attachment plate 2 may be flat or curved or otherwise adjusted to the contour of the mould or form.

A simple means for moving a vibrator or a vibrator pack is illustrated in FIG. 2, where a vibrator unit 1,2 is carried by an arm 5 attached to a driven screw 6. When the screw 6 is driven in one or other direction, the arm 5 can move the vibrator upwards or downwards on the mould. If the arm is locked to the screw 6 or a central shaft, the vibrator 1 may be moved around the mould wall 3 if the mould is round.

The means schematically illustrated in FIG. 2 indicates only one possibility of many for moving a vibrator on a mould or form.

Vibrators which may come into question include all kinds of known vibrators, i.e. electromechanical, air-powered mechanical and electromagnetic. There are interesting possibilities in respect of all these vibrators with regard to the nature of the vibration in the vibrator itself, in relation to the magnetic field in the electromagnet of the attachment plate 2. The attachment force against the mould wall 3 of the attachment plate 2 can be adjusted via the electromagnet, and thus the action of the vibration force on the mould wall 3 can also be adjusted.

The connection between a vibrator unit 1 and an arm 5 according to FIG. 2 should be elastically dampening, or arranged in some other way so that vibrations are transferred to as small an extent as possible to the driving member 4 of the arm 5.

With the vibrator in accordance with the invention there is thus enabled moving the vibrator on the mould or form during vibration, thus avoiding cavities, i.e. insufficiently vibrated places in the vibrated material, which is advantageous to the homogeneity of the vibrated material.

I claim:

1. Apparatus for vibrating mass materials in molds, forms or vessels including magnetically attractive walls, comprising at least one vibrator mounted on a mold, form or vessel, said vibrator being fastened to a magnet with the aid of which said vibrator is attached to the walls for mounting on the mold, form or vessel, means for carrying out vibration with said vibrator continuously while continuously moving the vibrator along the mold, form or vessel at the same time the mold, form or vessel is being filled with said material, and means continuously maintaining magnetic attraction between said magnet and said walls during said vibration and during movement of the vibrator along the mold.

2. Apparatus as claimed in claim 1, in which said vibrator has an attachment plate adapted to contact the mold, form or vessel, said attachment plate being flat.

* * * * *